US005845743A

United States Patent [19]

Dechant

[11] Patent Number: 5,845,743

[45] Date of Patent: Dec. 8, 1998

[54] POST STEP GRIPPING DEVICE

[76] Inventor: George A. Dechant, Rte. 3, Box 29, Stafford, Kans. 67578

[21] Appl. No.: 720,952

[22] Filed: Oct. 4, 1996

[51] Int. Cl.[6] ..... E04G 3/00

[52] U.S. Cl. ..... 182/187; 182/92; 248/246

[58] Field of Search ..... 182/90, 91, 92, 182/100, 187; 248/246, 295.11

[56] References Cited

U.S. PATENT DOCUMENTS

| | | | |
|---|---|---|---|
| 175,407 | 3/1876 | Beaumont, Jr. . | |
| 623,517 | 4/1899 | Carpenter . | |
| 2,086,280 | 7/1937 | Matter | 248/295 |
| 2,624,058 | 1/1953 | Kudrna | 182/91 X |
| 3,008,536 | 11/1961 | Linabery, Sr. | 182/187 |
| 3,195,680 | 7/1965 | Thornburg et al. | 182/92 |
| 3,504,767 | 4/1970 | Sherman | 182/187 X |
| 3,561,563 | 2/1971 | Harsh | 182/92 |
| 3,598,201 | 8/1971 | Thurmond | 182/92 |
| 3,817,350 | 6/1974 | Gray | 182/187 |
| 4,000,788 | 1/1977 | Burgess et al. | 182/92 |
| 4,754,841 | 7/1988 | Koffski | 182/92 |
| 4,947,961 | 8/1990 | Dudley | 182/92 |
| 5,111,909 | 5/1992 | Liu | 182/90 X |
| 5,311,967 | 5/1994 | Kennedy | 182/187 X |
| 5,407,025 | 4/1995 | Nickel | 182/92 |
| 5,501,475 | 3/1996 | Bundy | 182/92 X |
| 5,515,806 | 5/1996 | McCabe | 182/90 X |

FOREIGN PATENT DOCUMENTS

| | | | |
|---|---|---|---|
| 313127 | 5/1956 | Switzerland | 304/28 |

*Primary Examiner*—Daniel P. Stodola
*Assistant Examiner*—Richard M. Smith
*Attorney, Agent, or Firm*—John K. Flanagan; John R. Flanagan; Flanagan & Flanagan

[57] ABSTRACT

A post step gripping device, includes a flat planar platform for receiving the feet of a user, a horizontal support shaft attached by brackets and an intermediate support member to a first end of the platform, a pair of opposite arms pivotally attached to and slidably movable along the support shaft for attaching the device to a post, and a brace mounted to the bottom of the platform and a pair of angled plates attached to the pivotal connection of the arms to the support shaft for securing the platform in a substantially transverse position relative to the post. The brace, the angled plates and the arms operate in conjunction with the weight of the platform and/or the weight of the user standing on the platform to secure the device to the post. The device may also include a step member pivotally attached to an opposite second end of the platform and having a substantially U-shaped bar for receiving a foot of the user. The arms, brace and step member are pivotally movable between a retracted storage position, which permits the device to be stored in a convenient fashion, and an extended deployed position, which permits the device to be mounted to the post.

24 Claims, 2 Drawing Sheets

POST STEP GRIPPING DEVICE

BACKGROUND OF THE INVENTION

1. Field of the Invention

The present invention generally relates to gripping devices for flat sided posts and, more particularly, is concerned with a post step gripping device.

2. Description of the Prior Art

Posts are often used to support signs and the like and frequently have heights which are significantly greater than that of an average person. Signs are often affixed near or at the tops of these posts and therefore are out of the reach of most people. These signs often need repair or replacement and may require the attention of a person who is not tall enough to reach them and who may have to use a ladder or the like toward this end. A variety of devices have therefore been developed over the years to provide a means for the average person to reach signs and the like at or near the tops of posts.

Representative examples of these prior art devices are disclosed in U.S. Pat. No. 175,407 to Beaumont, Jr., U.S. Pat. No. 623,517 to Carpenter, U.S. Pat. No. 2,086,280 to Matter, U.S. Pat. No. 3,008,536 to Linabery, Sr., U.S. Pat. No. 3,561,563 to Harsh, U.S. Pat. No. 3,598,201 to Thurmond, U.S. Pat. No. 4,000,788 to Burgess et al., U.S. Pat. No. 4,754,841 to Koffski, U.S. Pat. No. 5,407,025 to Nickel and Swiss Pat. No. 313,127 to Stammler. These prior art devices generally provide a step platform or the like for a person to stand on. The Carpenter patent, in particular, discloses an adjustable bracket having an L-shaped body and a brace extending across the angle of the body and attached to the ends thereof. A pair of attaching arms are connected with the bracket and are adapted to embrace a post and support the bracket in position. The arms are pivotally attached to the bracket by a rod extending through eyes of the arms supported on opposite ends of the rod between nuts and the opposite ends of the body. While these prior art devices appear to be satisfactory in use for the specific purposes for which they were designed, none of them seem to provide a comprehensive and yet effective solution for the problem at hand. For instance, the attaching arms of the Carpenter device are captured at opposite ends of the rod between a step platform and the ends of the rod and this limits the movement of the attaching arms toward and away from each other which limits the range of post sizes for which the device can be employed.

Consequently, a need remains for a gripping device which provides a comprehensive and yet effective solution to the aforementioned problem in the prior art gripping devices without introducing any new problems in place thereof.

SUMMARY OF THE INVENTION

The present invention provides a post step gripping device designed to satisfy the aforementioned need. The post step gripping device of the present invention is adapted to fit a variety of post sizes and provides a comprehensive and yet effective solution for the average person to obtain access to signs and the like at or near the tops of posts. The post step gripping device secures to a post by using the weight of the device itself and/or the weight of a user stepping on the device to stabilize the device against the post.

Accordingly, the present invention is directed to a post step gripping device which comprises: (a) a flat planar platform for receiving the feet of a user; (b) a horizontal support shaft; (c) an attaching means for coupling the support shaft to the platform; (d) a pair of opposite arms pivotally attached to and slidably movable along the support shaft for attaching the device to a post; and (e) a retaining means for securing the platform in a substantially perpendicular position relative to the post. The retaining means and the arms operate in conjunction with the weight of the platform and/or the weight of the user standing on the platform to secure the device to the post.

The platform has a substantially rectangular or trapezoidal shape and has opposite first and second ends, opposite sides and opposite top and bottom surfaces. The platform more particularly is formed by a framework which includes a continuous peripheral member enclosing at least one and preferably a pair of cross members and a panel disposed over and fastened to the peripheral and cross members.

The support shaft has a substantially cylindrical shape and opposite ends. The attaching means includes a pair of brackets and an intermediate support member. Each bracket is attached at one end to an opposite end of the support shaft and at the other end to the front end of the platform. The intermediate support member is disposed between the pair of brackets and attached at one end to an intermediate point of the support shaft and at the other end to the first end of the platform. The pair of brackets and the support member dispose the support shaft in spaced relation above the platform.

Each arm has a first arm portion and a second arm portion. The first arm portion has opposite first and second ends. The first end defines a hinge pivotally attached to and slidably movable along the support shaft between one of the opposite ends of the support shaft and the intermediate support member of the attaching means. The second arm portion has opposite first and second ends together forming a substantially L-shaped configuration for embracing the post. The first end is attached to the second end of the first arm portion and is disposed in substantially perpendicular relation thereto. The second end is in substantially perpendicular relation to the first end.

The retaining means includes a brace and/or a pair of angled plates. The brace has opposite first and second end portions and a middle portion disposed between and interconnecting the first and second end portions. The first end portion is pivotally attached to the bottom surface of the platform. The second end portion is in substantially perpendicular relation to the middle portion thereof for contacting the post.

Each of the angled plates has vertical and horizontal portions rigidly attached at a right angle to one another. The vertical portion has first and second faces. The first face of the vertical portion of each angled plate is rigidly mounted to one of the hinges of the first arm portions of the arms. Each second face is for abutting the post. The horizontal portion of each angled plate is adapted to abut the underside of the first end of the platform to limit pivotal movement of the platfrom from a retracted stored position adjacent to the arms to a generally perpendicular extended deployed position relative to the arms.

The device further comprises a step member which includes a substantially U-shaped bar and at least one and preferably a pair of locking latches. The U-shaped bar is formed by opposite side vertical portions and a bottom horizontal portion disposed between and rigidly interconnecting the side vertical portions. The bottom horizontal portion is for receiving a foot of the user. The U-shaped bar has opposite ends pivotally attached to the opposite sides of and at the second end of the platform. Each of the locking latches is disposed between and attached to one of the opposite sides of the platform and an adjacent side vertical portion of the U-shaped bar.

The arms, the brace and the step member are pivotally movable between the retracted storage position and the extended deployed position. Each locking latch of the step member is movable between an extended position whereby the U-shaped bar of the step member is deployed in substantially perpendicular relation to the platform and a folded position whereby the U-shaped bar of the step member is retracted in substantially parallel relation to the platform.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
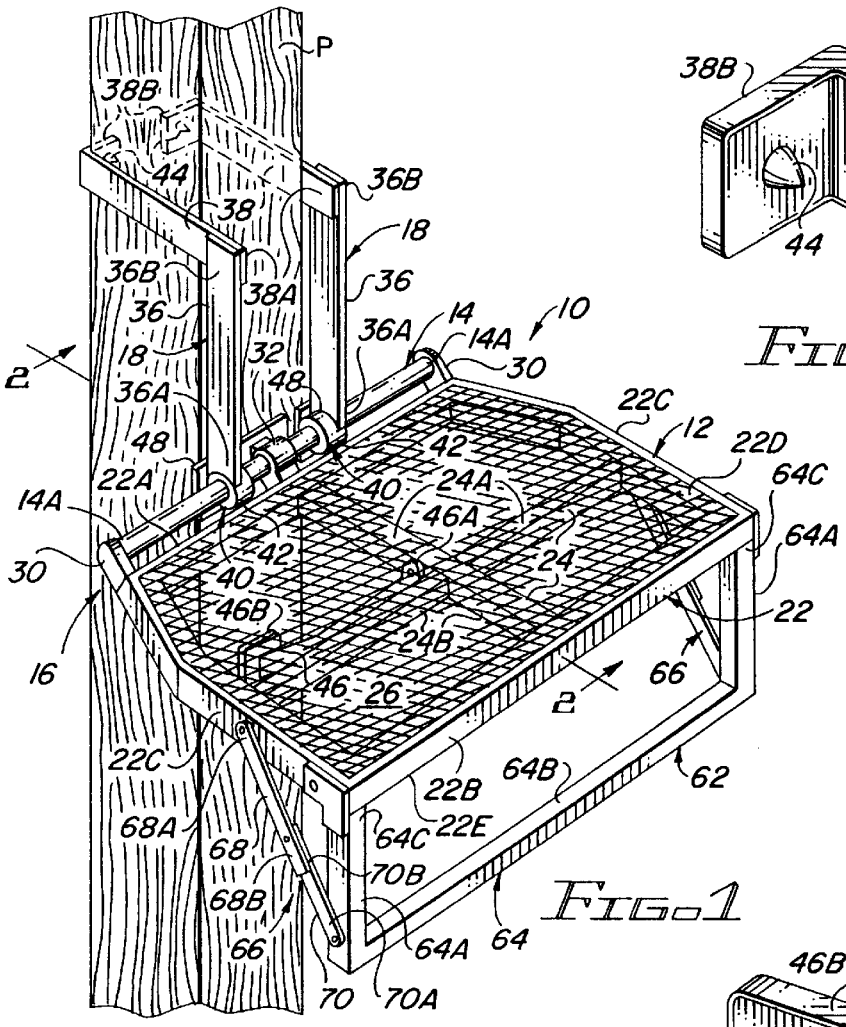
FIG. 1 is a perspective view of a post step gripping device of the present invention employed on a post.
Figure 3:
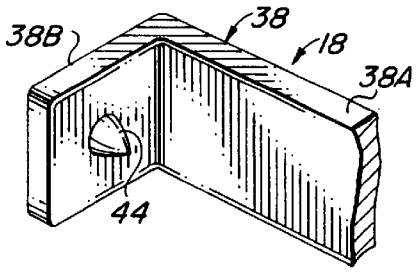
FIG. 3 is an enlarged detailed perspective view of the area of the device enclosed by circle 3 of FIG. 2.
Figure 4:
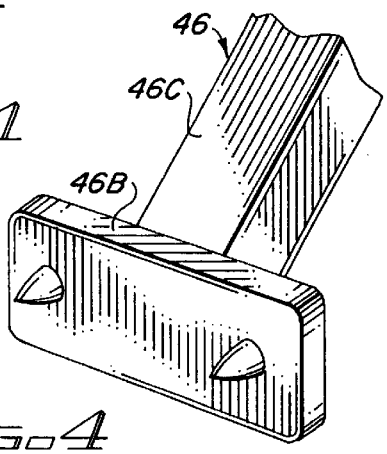
FIG. 4 is an enlarged detailed perspective view of the area of the device enclosed by circle 4 of FIG. 2.
Figure 2:
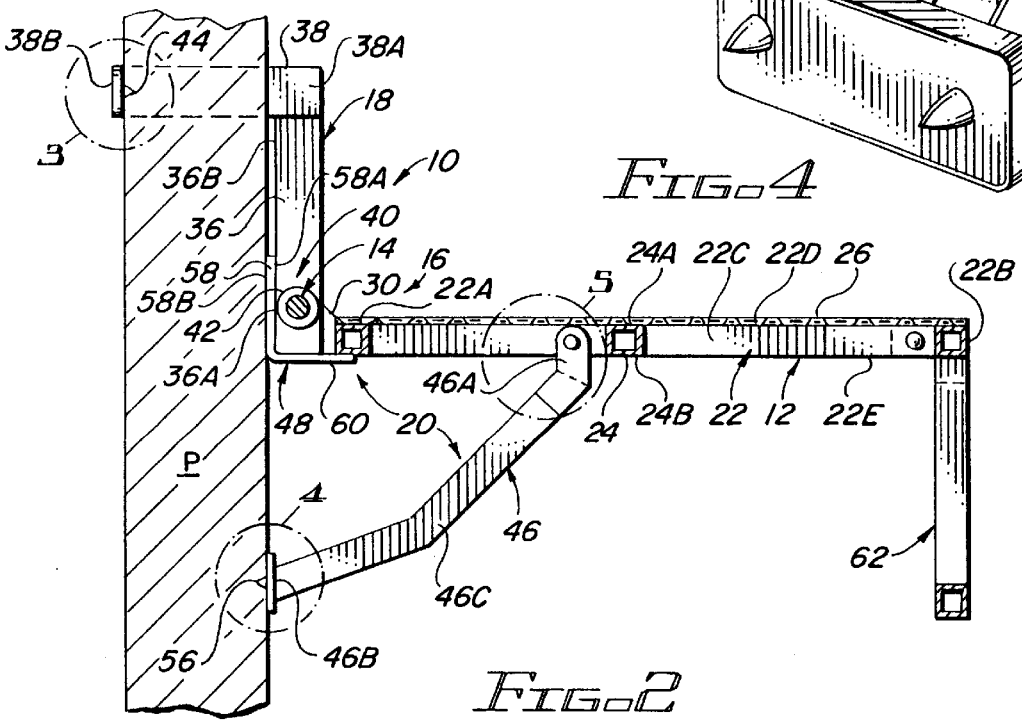
FIG. 2 is an enlarged partially sectional side elevational view of the post step gripping device taken along line 2—2 of FIG. 1.
Figure 5:
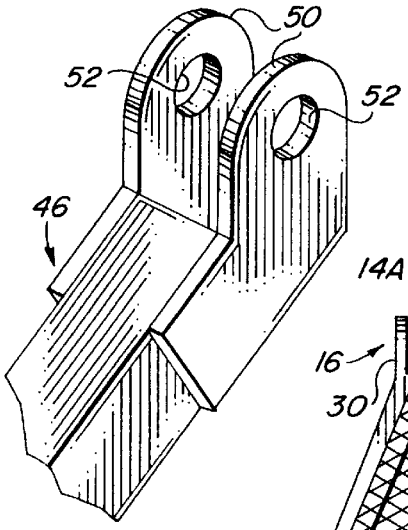
FIG. 5 is an enlarged detailed perspective view of the area of the device enclosed by circle 5 of FIG. 2.
Figure 6:
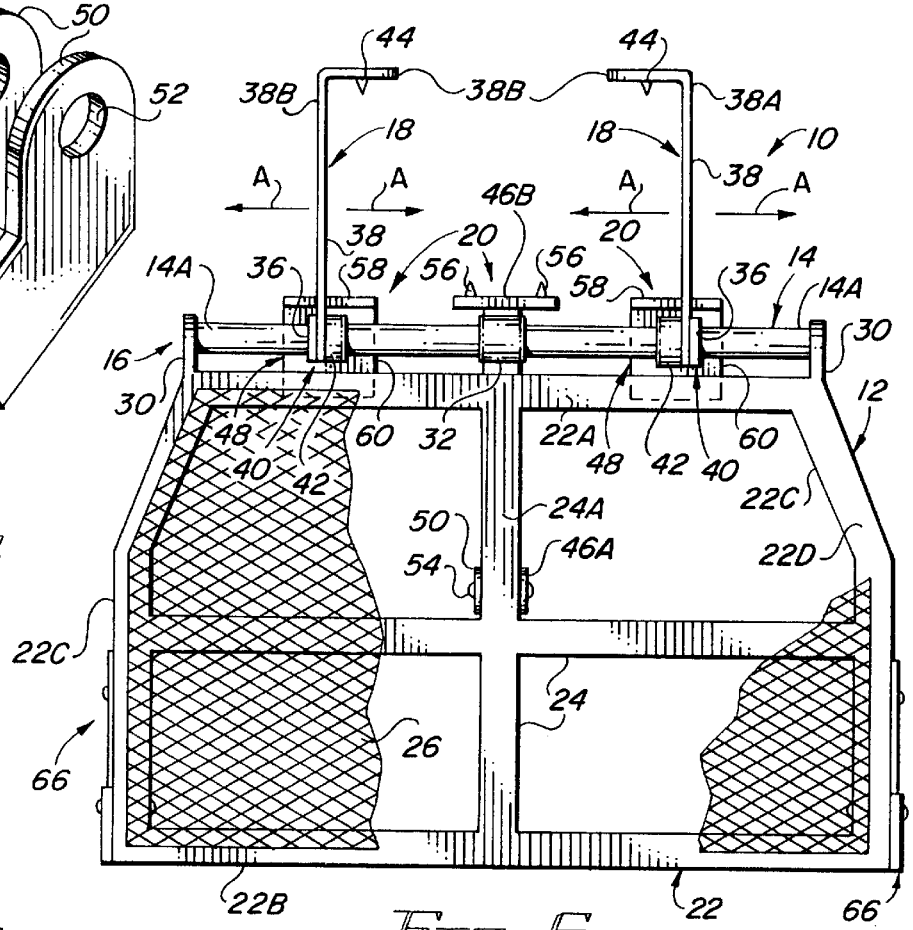
FIG. 6 is an enlarged top plan view of the device in an extended deployed position and showing a tread plate of a platform partially broken away.

Referring to the drawings and particularly to FIGS. 1 and 2, there is illustrated a post step gripping device, generally designated 10, of the present invention adapted to fit posts P having a variety of sizes such that a person of average height may obtain access to signs and the like at or near the tops of the posts P. The post step gripping device 10 basically includes a flat planar platform 12 for receiving the feet of a user, an elongated horizontal support shaft 14, attaching means 16 for coupling the support shaft 14 to the platform 12, a pair of opposite gripper arms 18 pivotally connected to and slidably movable along the support shaft 14, in the directions of arrows A in FIG. 6, for attaching the device 10 to the post P, and a retaining means 20 for securing the platform 12 in a transverse, preferably substantially perpendicular, position relative to the post P. The retaining means 20 and the arms 18 operate in conjunction with the weight of the platform 12 and/or the weight of the user standing on the platform 12 to secure the device 10 to the post P.

Referring to FIGS. 1, 2, 6 and 7, the platform 12 of the device 10 generally is flat and planar in configuration and has a substantially rectangular or trapezoidal shape, but can have any other suitable configuration. Also, the platform 12, being comprised of a substantially rigid material, has opposite first and second ends, opposite sides and opposite top and bottom surfaces. The platform 12 more particularly is formed by a framework which includes a continuous peripheral member 22 enclosing at least one and preferably a pair of cross members 24 and a panel 26 disposed over and fastened to the peripheral and cross members 22, 24.

The peripheral member 22 of the platform 12 defines the rectangular or trapezoidal configuration of the platform 12 and has opposite first and second ends 22A, 22B, opposite sides 22C and opposite top and bottom surfaces 22D, 22E. The first and second ends 22A, 22B represents the first and second ends of the platform 12. The opposite sides 22C represent the opposite sides of the platform 12. The opposite top and bottom surfaces 22D, 22E represent the opposite top and bottom surfaces of the platform 12. The peripheral member 22 generally has a substantially rectangular shape, but can have any other suitable shape, in cross-section.

The cross members 24 of the platform 12 are disposed between and attached to the opposite first and second ends 22A, 22B and to the opposite sides 22C of the peripheral member 22, and have opposite top and bottom surfaces 24A, 24B. Preferably, the two cross members 24 are disposed in substantially perpendicular relation to one another and define four open quadrants in the platform 12. A first of the cross members 24 is disposed between and attached to the opposite first and second ends 22A, 22B of the peripheral member 22 while a second of the cross members 24 is disposed between and attached to the opposite sides 22C of the peripheral member 22. The cross members 24 generally has the same substantially rectangular shape or other suitable shape in cross-section as and are integrally connected to the peripheral member 22.

The panel 26 of the platform 12 is in the form of a screen or a plate having a tread or gripping surface or the like providing a substantially slip-free surface for the feet of the user on the platform 12. The panel 26 is disposed over the top surfaces 22D, 24A of the peripheral and cross members 22, 24 of the platform 12 and is attached thereto by a plurality of fasteners (not shown), such as mateable bolts and nuts or the like.

The elongated horizontal support shaft 14 of the device 10 is comprised of a substantially rigid material and has a substantially cylindrical shape and opposite ends 14A. The attaching means 16 includes a pair of brackets 30 and an intermediate support member 32. The brackets 30 and support member 32, being comprised of a substantially rigid material, are attached at respective ones of their opposite ends to the opposite ends 14A and intermediate point of the support shaft 14 and at the others of their opposite ends to the front end 22A of the peripheral member 22 of the platform 12. The brackets 30 and support member 32 project outwardly and upwardly from the front end 22A of the peripheral member 22 to the opposite ends 14A and the intermediate point on the support shaft 14. In such manner, the pair of brackets 30 and support member 32 dispose the support shaft 14 in a spaced relation outwardly from and above the platform 12.

Referring now to FIGS. 1 to 3, 6 and 7, each gripper arm 18 of the device 10 is comprised of a substantially rigid material and has a first arm portion 36 and a second arm portion 38. The first and second arm portions 36, 38 are generally in the form of elongated flat bars. The first arm portion 36 of each arm 18 has opposite first and second ends 36A, 36B. The first end 36A of the first arm portion 36 of each arm 18 defines a hinge 40 pivotally coupled to and slidably movable along the support shaft 14 between a respective one of the opposite ends 14A of the support shaft 14 and the intermediate support member 32 of the attaching means 16. The hinge 40 is in the form of an annular collar 42 rotatably received over the support shaft 14.

The second arm portion 38 of each arm 18 has opposite first and second ends 38A, 38B which together form a substantially L-shaped configuration for embracing the post P. The first end 38A of the second arm portion 38 of each arm 18 is rigidly attached to the second end 36B of the first arm portion 36 of the corresponding arm 18 and is disposed in substantially perpendicular relation thereto. The second end 38B of the second arm portion 38 of each arm 18 extends in substantially perpendicular relation to the first end 38A thereof and preferably has a gripping element 44, such as a spike or the like, mounted thereon and protruding therefrom for engaging the post P. The gripping element 44 may be integral with or removably attached to the second end 38B and may be comprised of a substantially rigid material or any other suitable material.

Referring now to FIGS. 1, 2 and 4 to 7, the retaining means 20 of the device 10 includes a stabilizing brace 46 and/or a pair of angled plates 48. The brace 46 and angled plates 48 are comprised of a substantially rigid material. The brace 46 has opposite first and second end portions 46A, 46B and a middle portion 46C disposed between and interconnecting the first and second end portions 46A, 46B. The first end portion 46A is pivotally attached to the bottom surface 24B of the one cross member 24 of the platform 12. The first end portion 46A is in the form of a pair of spaced dog-leg shaped bars 50, as shown particularly in FIG. 5. Each dog-leg bar 50 defines a hole 52 therethrough for passage of a fastener 54 to pivotally mount the first end portion 46A to the one cross member 24 of the platform 12. The dog-leg shaped first end portion 46A of the brace 46 permits it to be pivoted to a storage position, as seen in solid line form in FIG. 7, in which the brace 46 lies flush against the bottom surface 24B of the one cross member 24.

The second end portion 46B of the brace 46 is fixed in substantially perpendicular relation to the middle portion 46C thereof and has at least one and preferably a pair of gripping elements 56, such as spikes or the like, mounted thereon and protruding therefrom for engaging the post P. Each gripping element 56 may be integral with or removably attached to the second end portion 46B of the brace 46 and may be comprised of a substantially rigid material or any other suitable material. The middle portion 46C has an overall dog-leg shape and a substantially rectangular shape in cross-section, although it can have any other suitable shape.

Each of the angled plates 48 of the retaining means 10 has vertical and horizontal portions 58, 60 rigidly attached at a right angle to one another. The vertical portion 48 has first and second faces 58A, 58B. The first face 58A of the vertical portion 58 of each angled plate 48 is rigidly mounted to one of the hinge collars 42 of the first arm portions 36 of the arms 18. Each second face 58B is for abutting against the post P which the arms 18 are in the deployed position shown in FIGS. 1, 2 and 6. The horizontal portion 60 of each angled plate 48 is adapted to abut the underside or bottom surface 22F of the first end 22A of the peripheral member 22 of the platform 12 when the arms are in the deployed position shown in FIGS. 1, 2 and 6 so as to limit pivotal movement of the platfrom 12 from a retracted stored position, as shown in solid line form in FIG. 7, adjacent to the arms 18 to the generally perpendicular extended deployed position relative to the arms 18, as shown in phantom line form in FIG. 7. The brace 46, angled plates 48 and arms 18, in conjunction with the weight of the platform 12, function or operate to secure the device 10 to the post P.

Figure 7:
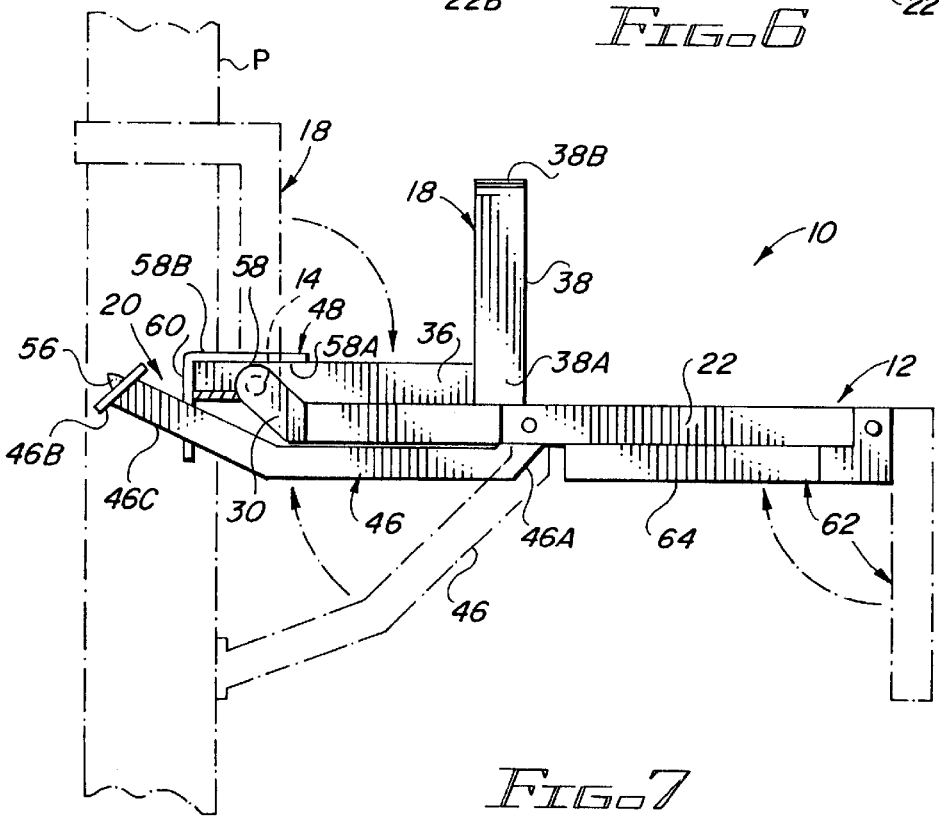
FIG. 7 is an enlarged side elevational view of the device in a retracted storage position and showing the device partially in phantom as it would appear deployed on the post.

Referring now to FIGS. 1, 2 and 7, the device 10 further comprises a step member 62 which includes a substantially U-shaped bar 64 and at least one and preferably a pair of locking latches 66. The U-shaped bar 64 and latches 66 are comprised of a substantially rigid material. The U-shaped bar 64 is formed by a pair of opposite side vertical portions 64A and a bottom horizontal portion 64B extending between and connecting with lower ends of the side vertical portions 64A. The bottom horizontal portion 64B is provided for receiving a foot of the user thereon for assisting the user in climbing up onto the platform 12. The U-shaped bar 64 also has opposite ends 64C pivotally connected to the opposite sides 22C of and at the second end 22B of the peripheral member 22 of the platform 12. Each opposite end 64C is in the form of a dog-leg which permits the U-shaped bar 64C to be folded up against the bottom surface of the platform 12.

Each of the locking latches 66 is formed by a pair of elongated latch members 68, 70 each having opposite first and second ends 68A, 68B and 70A, 70B. The first end 68A of a first of the pair of elongated latch members 68 is attached to one of the opposite sides 22C of and at a point intermediate between the first and second ends 22A, 22B of the peripheral member 22 of the platform 12. The first end 70A of a second of the pair of elongated latch members 70 is attached to an adjacent side vertical portion 64A of and at a point adjacent to the bottom horizontal portion 64B of the U-shaped bar 64. The second ends 68B, 70B of the first and second elongated latch members 68, 70 are pivotally connected to one another. Portions of the first and second latch members 68, 70 overlap and releasably lock to one another, when in extended latched positions. The locking force retaining the arms in the latched positions can be overcome manually to permit folding of the first and second latch members 68, 70 into folded unlatched positions relative to one another.

The arms 18, brace 46 and step member 62 are pivotally movable manually between the retracted storage position, as shown particularly in FIG. 7, and the extended deployed position, as shown particularly in FIGS. 1 and 2 and partially in phantom in FIG. 7. The first and second elongated latch members 68, 70 of each of the locking latches 66 of the step member 62 are movable to the extended latched positions when the U-shaped bar 64 of the step member 62 is deployed in substantially perpendicular relation to the platform 12 and the folded unlatched positions when the U-shaped bar 64 of the step member 62 is retracted in substantially parallel relation to the platform 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A post step gripping device, comprising:

(a) a flat planar platform for receiving the feet of a user;

(b) a horizontal support shaft having a pair of opposite ends and an intermediate location on said support shaft between said opposite ends thereof;

(c) attaching means for coupling said support shaft to said platform and positioning said support shaft-and-said intermediate location thereon in spaced relation above said platform;

(d) a pair of opposite arms each coupled to said support shaft for undergoing pivotal movement relative to said support shaft and slidable movable along said support shaft above said platform and between one of said opposite ends of said support shaft and said intermediate location thereon for attaching said device to a post; and (e) retaining means for securing said platform in a substantially transverse position relative to the post, said retaining means and arms operating in conjunction with the weight of said platform to secure said device to the post.

2. The device of claim 1 wherein said attaching means includes a pair of brackets, each said bracket extending between and attached to said platform and one of said opposite ends of said support shaft.

3. The device of claim 2 wherein said attachment means further includes an intermediate support member disposed between said pair of brackets and connecting said support shaft at said intermediate location thereon to said platform, said pair of brackets and said support member disposing said support shaft in said spaced relation above said platform.

4. A post step gripping device, comprising:

(a) a flat planar platform for receiving the feet of a user;

(b) a horizontal support shaft;

(c) attaching means for coupling said support shaft to said platform;

(d) a pair of opposite arms pivotally coupled to and slidably movable along said support shaft for attaching said device to a post; and (e) retaining means for securing said platform in a substantially transverse position relative to the post, said retaining means and arms operating in conjunction with the weight of said platform to secure said device to the post, said retaining means including a brace having opposite first and second end portions and a middle portion disposed between and interconnecting said first and second end portions, said first end portion thereof being pivotally connected to a bottom surface of said platform and said second end portion thereof being in substantially transverse relation to said middle portion thereof for contacting the post, whereby said brace and said arms operate in conjunction with the weight of said platform to secure said device to the post.

5. The device of claim 1 wherein said second end portion of said brace has at least one gripping element mounted thereon for contacting the post.

6. A post step gripping device, comprising:

(a) a flat planar platform for receiving the feet of a user;

(b) a horizontal support shaft;

(c) attaching means for coupling said support shaft to said platform;

(d) a pair of opposite arms pivotally coupled to and slidably movable along said support shaft for attaching said device to a post; and (e) retaining means for securing said platform in a substantially transverse position relative to the post, said retaining means and arms operating in conjunction with the weight of said platform to secure said device to the post, said retaining means including a pair of angled plates each having vertical and horizontal portions rigidly attached at a substantially right angle to one another, said vertical portion of each angled plate being rigidly mounted to one of said arms and for abutting the post, said horizontal portion of each angled plate being adapted to abut a bottom of said platform to limit pivotal movement of said platform from a retracted stored position adjacent to said arms to a generally perpendicular extended deployed position relative to said arms.

7. A post step gripping device, comprising:

(a) a flat planar platform for receiving the feet of a user and including (i) a first end, (ii) a continuous peripheral member having a substantially rectangular cross-section and a top surface, (iii) at least one cross member disposed between and attached to opposite portions of said Peripheral member and having a top surface, and (iv) a panel disposed over and fastened to said top surfaces of said peripheral and cross members;

(b) a horizontal support shaft having opposite ends;

(c) means for attaching said support shaft to said first end of said platform;

(d) a pair of opposite arms for attaching said device to a post, each said arm including (i) a first arm portion having opposite first and second ends, said first end thereof defining a hinge pivotally coupled to and slidably movable along said support shaft, and (ii) a second arm portion having opposite first and second ends together forming a substantially L-shaped configuration for embracing the post, said first end of said second arm portion being attached to said second end of said first arm portion and disposed in substantially perpendicular relation to said second end of said first arm portion and said second end of said second arm portion being in substantially perpendicular relation to said first end of said second arm portion; and (e) means for retaining said platform in a substantially perpendicular position relative to the post, whereby said retaining means and said arms operate in conjunction with the weight of said platform to secure said device to the post.

8. A post step gripping device, comprising:

(a) a flat planar platform for receiving the feet of a user and having a first end;

(b) a horizontal support shaft having opposite ends;

(c) means for attaching said support shaft to said first end of said platform, said attaching means including (i) a pair of brackets, each said bracket extending between and attached to one of said opposite ends of said support shaft and said first end of said platform, and (ii) an intermediate support member disposed between said pair of brackets and connecting said support shaft to said first end of said platform, said pair of brackets and said support member disposing said support shaft in spaced relation above said platforms (d) a pair of opposite arms for attaching said device to a post, each said arm including (i) a first arm portion having opposite first and second ends, said first end thereof defining a hinge pivotally coupled to and slidably movable along said support shaft, and (ii) a second arm portion having opposite first and second ends together forming a substantially L-shaped configuration for embracing the post, said first end of said second arm portion being attached to said second end of said first arm portion and disposed in substantially perpendicular relation to said second end of said first arm portion and said second end of said second arm portion being in substantially perpendicular relation to said first end of said second arm portion; and (e) means for retaining said platform in a substantially perpendicular position relative to the post, whereby said retaining means and said arms operate in conjunction with the weight of said platform to secure said device to the post.

9. The device of claim 8 wherein said arms are pivotally movable between a retracted storage position and an extended deployed position.

10. The device of claim 8 wherein said second end of said second arm portion of each said arm has a gripping element mounted thereon for contacting the post.

11. A post step gripping device, comprising:

(a) a flat planar platform for receiving the feet of a user and having a first end and a bottom surface;

(b) a horizontal support shaft having opposite ends;

(c) means for attaching said support shaft to said first end of said platform;

(d) a pair of opposite arms for attaching said device to a post, each said arm including (i) a first arm portion having opposite first and second ends, said first end thereof defining a hinge pivotally coupled to and slidably movable along said support shaft, and (ii) a second arm portion having opposite first and second ends together forming a substantially L-shaped configuration for embracing the post, said first end of said second arm portion being attached to said second end of said first arm portion and disposed in substantially perpendicular relation to said second end of said first arm portion and said second end of said second arm portion being in substantially perpendicular relation to said first end of said second arm portion; and (e) means for retaining said platform in a substantially perpendicular position relative to the post, whereby said retaining means and said arms operate in conjunction with the weight of said platform to secure said device to the post, said retaining means including a brace having opposite first and second end portions and a middle portion disposed between and interconnecting said first and second end portions, said first end portion thereof being pivotally coupled to said bottom surface of said platform and said second end portion thereof being in substantially perpendicular relation to said middle portion thereof and for contacting the post, whereby said brace and said arms operate in conjunction with the weight of said platform to secure said device to the post.

12. The device of claim 11 wherein said brace of said retaining means is pivotally movable between a retracted storage position and an extended employed position.

13. The device of claim 11 wherein said second end portion of said brace of said retaining means has at least one gripping element mounted thereon for contacting the post.

14. The device of claim 11 wherein said platform further has an opposite second end and opposite sides, and said device further comprises:

(e) a step member including (i) a substantially U-shaped bar formed by opposite side vertical portions and a bottom horizontal portion disposed between and interconnecting said side vertical portions, said bottom horizontal portion for receiving a foot of the user, said U-shaped bar having opposite ends pivotally connected to said opposite sides of and at said second end of said platform, and (ii) at least one locking latch formed by a pair of elongated latch members each having opposite first and second ends, said first end of a first of said pair of elongated latch members being attached to one of said opposite sides of and at a point intermediate between said first and second ends of said platform, said first end of a second of said pair of elongated latch members being attached to an adjacent said side vertical portion of and at a point adjacent to said bottom horizontal portion of said U-shaped bar, said second ends of said first and second elongated latch members being pivotally connected to one another.

15. The device of claim 14 wherein said first and second elongated latch members of said locking latch of said step member are movable between an extended position whereby said U-shaped bar of said step member is employed in substantially perpendicular relation to said platform and a folded position whereby said U-shaped bar of said step member is retracted in substantially parallel relation to said platform.

16. A post step gripping device, comprising:

(a) a flat planar platform for receiving the feet of a user and having a first end;

(b) a horizontal support shaft having opposite ends;

(c) means for attaching said support shaft to said first end of said platform;

(d) a pair of opposite arms for attaching said device to a post, each said arm including (i) a first arm portion having opposite first and second ends, said first end thereof defining a hinge pivotally coupled to and slidably movable along said support shaft, and (ii) a second arm portion having opposite first and second ends together forming a substantially L-shaped configuration for embracing the post, said first end of said second arm portion being attached to said second end of said first arm portion and disposed in substantially perpendicular relation to said second end of said first arm portion and said second end of said second arm portion being in substantially perpendicular relation to said first end of said second arm portion; and (e) means for retaining said platform in a substantially perpendicular position relative to the post, whereby said retaining means and said arms operate in conjunction with the weight of said platform to secure said device to the post, said retaining means including a pair of angled plates each having vertical and horizontal portions rigidly attached at a substantially right angle to one another, said vertical portion of each angled plate being rigidly mounted to one of said arms and for abutting the post, said horizontal portion of each angled plate being adapted to abut a bottom of said platform to limit pivotal movement of said platform from a retracted stored position adjacent to said arms to a generally perpendicular extended deployed position relative to said arms.

17. A post step gripping device, comprising:

(a) a flat planar platform for receiving the feet of a user and having a first end and a bottom surface;

(b) a horizontal support shaft having opposite ends;

(c) means for attaching said support shaft to said first end of said platform;

(d) a pair of opposite arms for attaching said device to a post, each said arm including (i) a first arm portion having opposite first and second ends, said first end thereof defining a hinge pivotally attached to and slidably movable along said support shaft, and (ii) a second arm portion having opposite first and second ends together forming a substantially L-shaped configuration for embracing the post, said first end of said second arm portion being attached to said second end of said first arm portion and disposed in substantially perpendicular relation to said second end of said first arm portion and said second end said second arm portion being in substantially perpendicular relation to said first end of said second arm portion;

(e) a brace having opposite first and second end portions and a middle portion disposed between and interconnecting said first and second end portions, said first end portion thereof being pivotally coupled to said bottom surface of said platform and said second end portion thereof being in substantially transverse relation to said middle portion thereof and for contacting the post; and (f) a pair of angled plates each having vertical and horizontal portions rigidly attached at a substantially right angle to one another, said vertical portion of each angled plate being rigidly mounted to one of said arms and for abutting the post, said horizontal portion of each angled plate being adapted to abut said bottom surface of said platform to limit pivotal movement of said platform from a retracted stored position adjacent to said arms to a generally perpendicular extended deployed position relative to said arms, said brace, said angled plates and said arms operate in conjunction with the weight of said platform to secure said device to the post.

18. The device of claim 17 wherein said platform further includes:

a continuous peripheral member having a substantially rectangular shape and a top surface;

at least one cross member disposed between and attached to opposite portions of said peripheral member and having a top surface; and a panel disposed over and fastened to said top surfaces of said peripheral and cross members.

19. The device of claim 17 wherein said attaching means includes:

a pair of brackets, each said bracket extending between and attached to one of said opposite ends of said support shaft and said first end of said platform; and an intermediate support member disposed between said pair of brackets and connecting said support shaft to said first end of said platform, said pair of brackets and said support member disposing said support shaft in spaced relation above said platform.

20. The device of claim 17 wherein said arms and said brace are each pivotally movable between a retracted storage position and an extended employed position.

21. The device of claim 17 wherein said second end of said second arm portion of each said arm has a gripping element mounted thereon for contacting the post.

22. The device of claim 17 wherein said second end of said brace has at least one gripping mounted thereon for contacting the post.

23. The device of claim 17 wherein said platform further has an opposite second end and opposite sides, and said device further comprises:

(f) a step member including (i) a substantially U-shaped bar formed by opposite side vertical portions and a bottom horizontal portion disposed between and interconnecting said side vertical portions, said bottom horizontal portion for receiving a foot of the user, said U-shaped bar having opposite ends pivotally attached to said opposite sides of and at said second end of said platform, and (ii) at least one locking latch formed by a pair of elongated latch members each having opposite first and second ends, said first end of a first of said pair of elongated latch members being attached to one of said opposite sides of and at a point intermediate between said first and second ends of said platform, said first end of a second of said pair of elongated latch members being attached to an adjacent said side vertical portion of and at a point adjacent to said bottom horizontal portion of said U-shaped member, said second ends of said first and second elongated latch members being pivotally connected to one another.

24. The device of claim 23 wherein said first and second elongated latch members of said locking latch of said step member are movable between an extended position whereby said U-shaped bar of said step member is employed in substantially perpendicular relation to said platform and a folded position whereby said U-shaped bar of said step member is retracted in substantially parallel relation to said platform.

* * * * *